US007297250B2

(12) United States Patent
Bronicki

(10) Patent No.: US 7,297,250 B2
(45) Date of Patent: Nov. 20, 2007

(54) METHOD OF AND APPARATUS FOR PROCESSING HEAVY HYDROCARBON FEEDS

(75) Inventor: Yoram Bronicki, Rehovot (IL)

(73) Assignee: Ormat Industries Ltd., Yavne (IL)

( * ) Notice: Subject to any disclaimer, the term of this patent is extended or adjusted under 35 U.S.C. 154(b) by 129 days.

(21) Appl. No.: 10/972,270

(22) Filed: Oct. 25, 2004

(65) Prior Publication Data

US 2006/0032789 A1 Feb. 16, 2006

Related U.S. Application Data

(62) Division of application No. 09/431,159, filed on Nov. 1, 1999, now abandoned.

(51) Int. Cl.
*C10G 9/14* (2006.01)
*C10G 7/00* (2006.01)

(52) U.S. Cl. ..... 208/132; 208/50; 208/86; 208/92; 208/94; 208/251 R; 208/309; 422/189

(58) Field of Classification Search ..... 208/50, 208/86, 92, 132, 251 R, 309, 94; 422/189
See application file for complete search history.

(56) References Cited

U.S. PATENT DOCUMENTS 4,039,429 A * 8/1977 VAN Klinken et al. ..... 208/50
4,087,354 A * 5/1978 Hessler ..... 208/251 R
4,500,416 A * 2/1985 van Dongen et al. ..... 208/86
5,976,361 A * 11/1999 Hood et al. ..... 208/309

* cited by examiner

*Primary Examiner*—Glenn Caldarola
*Assistant Examiner*—Prem C. Singh
(74) *Attorney, Agent, or Firm*—The Nath Law Group; Gary M. Nath; Jerald L. Meyer

(57) ABSTRACT

The present invention comprises a method for processing a heavy hydrocarbon feed including: supplying the heavy hydrocarbon feed to a heater for heating the heavy hydrocarbon feed; supplying the heated heavy hydrocarbon feed to an atmospheric fractionating tower for fractionating the heated heavy hydrocarbon feed fed to the inlet of the atmospheric fractionating tower producing light atmospheric fractions and atmospheric bottoms; supplying the atmospheric bottoms to a further heater for heating the atmospheric bottoms and producing heated atmospheric bottoms; supplying the heated atmospheric bottoms to a vacuum fractionating tower for fractionating the heated atmospheric bottoms and producing light vacuum fractions and vacuum residue; supplying the vacuum residue to a solvent deasphalting (SDA) unit for producing deasphalted oil (DAO) and asphaltenes from the vacuum residue; supplying the deasphalted oil to a deasphalted oil thermal cracker for thermally cracking the deasphalted oil and producing a thermally cracked product which is recycled only to the inlet of the atmospheric fractionating tower; and supplying the light vacuum fractions to a light vacuum fraction thermal cracker for thermally cracking the light vacuum fractions for producing a further cracked product which is recycled only to the inlet of the atmospheric fractionating tower.

1 Claim, 10 Drawing Sheets

METHOD OF AND APPARATUS FOR PROCESSING HEAVY HYDROCARBON FEEDS

This is a divisional of U.S. patent application Ser. No. 09/431,159, filed Nov. 1, 1999 now abandoned.

TECHNICAL FIELD

This invention relates to processing heavy hydrocarbon feeds containing sulfur, metals and asphaltenes which may be used in refineries and/or producing power, and more particularly, to a method of and apparatus for upgrading heavy crude oils or fractions thereof.

BACKGROUND OF THE INVENTION

Many types of heavy crude oils contain high concentrations of sulfur compounds, organo-metallic compounds, and heavy non-distillable fractions called asphaltenes that are insoluble in light paraffins such as n-pentane. Because most petroleum products used for fuel must have a low sulfur content, the sulfur compounds in the non-distillible fractions reduce their value to petroleum refiners and increase their cost to users of such fractions as fuel or as raw material for producing other products. In order to increase the saleability of these non-distillable fractions, refiners must resort to various expedients for removing sulfur compounds.

A conventional approach to removing sulfur compounds in distillable fractions of crude oil, or its derivatives, is catalytic hydrogenation in the presence of molecular hydrogen at moderate pressure and temperature. While this approach is cost effective in removing sulfur from distillable oils, problems arise when the feed includes metallic containing asphaltenes. Specifically, the presence of metallic containing asphaltenes results in catalyst deactivation by reason of the coking tendency of the asphaltenes, and the accumulation of metals on the catalyst, especially nickel and vanadium compounds commonly found in the asphaltenes.

Alternative approaches include coking, high-pressure, desulfurization and fluidized catalytic cracking of non-distillable oils, and production of asphalt for paving and other uses. All of these processes, however, have disadvantages that are intensified by the presence of high concentrations of metals, sulfur and asphaltenes. In the case of coking non-distillable oils, the cost is high and a disposal market for the resulting high sulfur coke must be found. Furthermore, the products produced from the asphaltene portion of the feed to a coker are almost entirely low valued coke and cracked gases. In the case of residual oil desulfurization, the cost of high pressure equipment, catalyst consumption, and long processing times make this alternative undesirably expensive.

In U.S. Pat. No. 4,191,636, heavy oil is continuously converted into asphaltenes and metal-free oil by hydrotreating the heavy oil to crack asphaltenes selectively and remove heavy metals such as nickel and vanadium simultaneously. The liquid products are separated into a light fraction of an asphaltene-free and metal-free oil and a heavy fraction of an asphaltene and heavy metal-containing oil. The light fraction is recovered as a product and the heavy fraction is recycled to the hydrotreating step.

In U.S. Pat. No. 4,528,100, a process for the treatment of residual oil is disclosed, the process comprising the steps of treating the residual oil so as to produce a first extract and a first raffinate using supercritical solvent extraction, and then treating the first raffinate so as to produce a second extract and a second raffinate again by second raffinate again by supercritical solvent extraction using a second supercritical solvent and then combining the first extract and the raffinate to a product fuel. In accordance with a particular embodiment of the invention disclosed in the U.S. '100 patent, the supercritical solvents are particularly selected to concentrate vandium in the second extract. Thus, even though the amount of vandium present in the produce fuel is low and consequently beneficial for reducing gas turbine maintenance problems as stated in this '100 patent, some amount of vanadium does still remain therein.

Another example of a user of the heavier, higher boiling range portion of a hydrocarbon is a refinery with a fluid catalytic cracking unit (a FCC unit). FCC units typically are operated with a feedstock quality constraint of very low metals asphaltenes, and CCR (i.e., less than 10 wppm metals, less than 0.2 wt % asphaltenes, and less than 2 wt % CCR). Utilization of feedstocks with greater levels of asphaltenes of CCR results in increased coke production and a corresponding reduction in unit capacity. In addition, use of feedstocks with high levels of metals and asphaltenes results in more rapid deactivation of the catalyst, and thus increased catalyst rates and increased catalyst replacement costs.

In U.S. Pat. No. 5,192,421, a process for the treatment of whole crude oil is disclosed, the process comprising the steps of deasphalting the crude by first mixing the crude with an aromatic solvent, and then mixing the crude-aromatic solvent mixture with an aliphatic solvent. The U.S. '421 patent (at page 9, lines 43-45) identifies that certain modifications must be made to prior art solvent deasphalting technologies, such as that described in U.S. Pat. Nos. 2,940,920, 3,005,769, and 3,053,751 in order to accommodate the process described in the U.S. '421 patent, in particular since the prior art solvent deasphalting technologies have no means to remove that portion of the charge oil that will vaporize concurrently with the solvent and thus contaminate the solvent used in the process. In addition to being burdened by the complexity and cost resulting from the use of two solvents, the U.S. '421 process results in a deasphalted product that still contains a non-distilled portion with levels of CCR and metals that exceed the desired levels of such contaminants.

In U.S. Pat. No. 4,686,028 a process for the treatment of whole crude oil is disclosed, the process comprising the steps of deasphalting a high boiling range hydrocarbon in a two-stage deasphalting process to separate asphaltene, resin, and deasphalted fractions by hydrogenation or visbreaking. The U.S. '028 patent is burdened by the complexity and cost of a two-stage solvent deasphalting system used to separate the resin fraction from the deasphalting oil. In addition, like the U.S. '421 patent, the '028 process results in an upgraded product that still contains a non-distilled fraction—the DAO—that is contaminated with CCR and metals.

Metals contained in heavy oils contaminate and spoil the performance of catalysts in fluidized catalytic cracking units. Asphaltenes present in such oils are converted to high yields of coke and gas which burden an operator with high burning requirements.

Another alternative available to a refiner or heavy crude user is to dispose of the non-distillable heavy oil fractions as fuel for industrial power generation or as bunker fuel for ships. Disposal of such fractions as fuel is not particularly profitable to a refiner because more valuable distillate oils must be added in order to reduce viscosity sufficiently (e.g. producing heavy fuel oil, etc.) to allow handling and shipping. Furthermore, the presence of high sulfur and metals contaminants lessens the value to the users. In addition, this does not solve the problem of the non-distillable heavy oil fractions in a global sense since environmental regulations restrict the use of high sulfur fuel oil. Refiners frequently use a thermal conversion process, e.g., visbreaking, for reducing the heavy fuel oil yield. This process converts a limited amount of the heavy oil to lower viscosity light oil, but has the disadvantage of using some of the higher value distillate oils to reduce the viscosity of the heavy oil sufficiently to allow handling and shipping. Moreover, the asphaltene content of the heavy oil restricts severely the degree of visbreaking conversion possible due to the tendency of the asphaltenes to condense into heavier materiels, even coke, and cause instability in the resulting fuel oil. Furthermore, this process reduces the amount of heavy fuel oil that the refiner has to sell and is not useful in a refinery processing heavy crudes.

Many proposals thus have been for dealing with crude oil and metals. And while many are technically viable, they appear to have achieved little or no commercialization, due, in large measure, to the high cost of the technology involved. Usually such cost takes the form of increased catalyst contamination by the metals and/or the carbon deposition resulting from the attempted conversion of the asphaltene fractions.

An example of the processes proposed in order to cope with high metals and asphaltenes is disclosed in U.S. Pat. No. 4,500,416. In one embodiment, an asphaltene-containing hydrocarbon feed is solvent deasphalted in a deasphalting zone to produce a deasphalted oil (DAO) fraction, and an asphaltene fraction which is catalytically hydrotreated in a hydrotreating zone to produce a reduced asphaltene stream that is fractionated to produce light distillate fractions and a first heavy distillate fraction. Both the first heavy distillate fraction and the DAO fraction are thermally cracked into a product stream that is then fractionated into light distillate fractions and a second distillate fraction which is routed to the hydrotreating zone.

In an alternative embodiment, an asphaltene-containing hydrocarbon feed is solvent deasphalted in a deasphalting zone to produce a deasphalted oil (DAO) fraction, and an asphaltene fraction which is catalytically hydrotreated in a hydrotreating zone to produce a reduced asphaltene stream that is fractionated to produce light distillate fractions and a first heavy distillate fraction. The first heavy distillate fraction is routed to the deasphalting zone for deasphalting, and the DAO fraction is thermally cracked into a product stream that is then fractionated into light fractions and a second heavy distillate fraction which is routed to the hydrotreating zone.

In each embodiment in the '416 patent, asphaltenes are routed to a hydrotreating zone wherein heavy metals present in the asphaltenes cause a number of problems. Primarily, the presence of the heavy metals in the hydrotreater causes deactivation of the catalyst that increases the cost of the operation. In addition, such heavy metals also result in having to employ higher pressures in the hydrotreater which complicates its design and operation and hence its cost.

It is therefore an object of the present invention to provide a new and improved method of and apparatus for processing and upgrading heavy hydrocarbon feeds containing sulfur, metals, and asphaltenes, wherein the disadvantages as outlined are reduced or substantially overcome.

SUMMARY OF THE INVENTION

Apparatus for processing a heavy hydrocarbon feed, in accordance with the present invention, comprises firstly a heater for heating the heavy hydrocarbon feed. The heated heavy hydrocarbon feed produced is fed to an atmospheric fractionating tower for fractionating the heated heavy hydrocarbon feed fed to the inlet of the atmospheric fractionating tower producing light atmospheric fractions and atmospheric bottoms. In addition, the apparatus includes a vacuum fractionating tower for fractionating heated atmospheric bottoms, heated by a further heater, and producing lighter vacuum fractions and vacuum residue. Furthermore, the apparatus includes a solvent deasphalting (SDA) unit for producing deasphalted oil (DAO) and asphaltenes from the vacuum residue as well as a thermal cracker for thermally cracking the deasphalted oil and producing a thermally cracked product which is recycled to the inlet of the atmospheric fractioning tower. Moreover, the apparatus can include a further thermal cracker for thermally cracking the lighter vacuum fractions for producing a further thermally cracked product which is recycled to the inlet of the atmospheric fractionating tower. If preferred, the lighter vacuum fractions can be supplied to the thermal cracker in addition to the deasphalted oil. In such a case, the further thermal cracker previously mentioned is not used.

Furthermore, the present invention includes a method for processing a heavy hydrocarbon feed comprising the steps of: heating a heavy hydrocarbon feed and fractionating the heated heavy hydrocarbon feed in an atmospheric fractionating tower for producing light atmospheric fractions and atmospheric bottoms. Heated atmospheric bottoms, heated by a further heater, are fractioned in a vacuum fractioning tower for producing lighter vacuum fractions and vacuum residue while the vacuum residue are solvent deasphalted in a solvent deasphalting (SDA) unit for producing deasphalted oil (DAO) and asphaltenes. The deasphalted oil is then thermally cracked in a thermal cracker for producing a thermally cracked product that is recycled to the inlet of the atmospheric fractionating tower. In addition, the lighter vacuum fractions can be thermally cracked for producing a further thermally cracked product that is recycled to the inlet of the atmospheric fractionating tower. Thermal cracking of the lighter vacuum fractions can be carried out in a separate thermal cracker or in the same thermal cracker in which the deasphalted oil is thermally cracked. Similar apparatus and methods are disclosed in U.S. patent application Ser. No. 08/910,102, the disclosure of which is hereby incorporated by reference.

BRIEF DESCRIPTION OF THE DRAWINGS

Embodiments of the present invention are described by way of example, and with reference to the accompanying drawings wherein.

Like reference numerals and designations in the various drawings refer to like elements.

DETAILED DESCRIPTION

Figure 1:
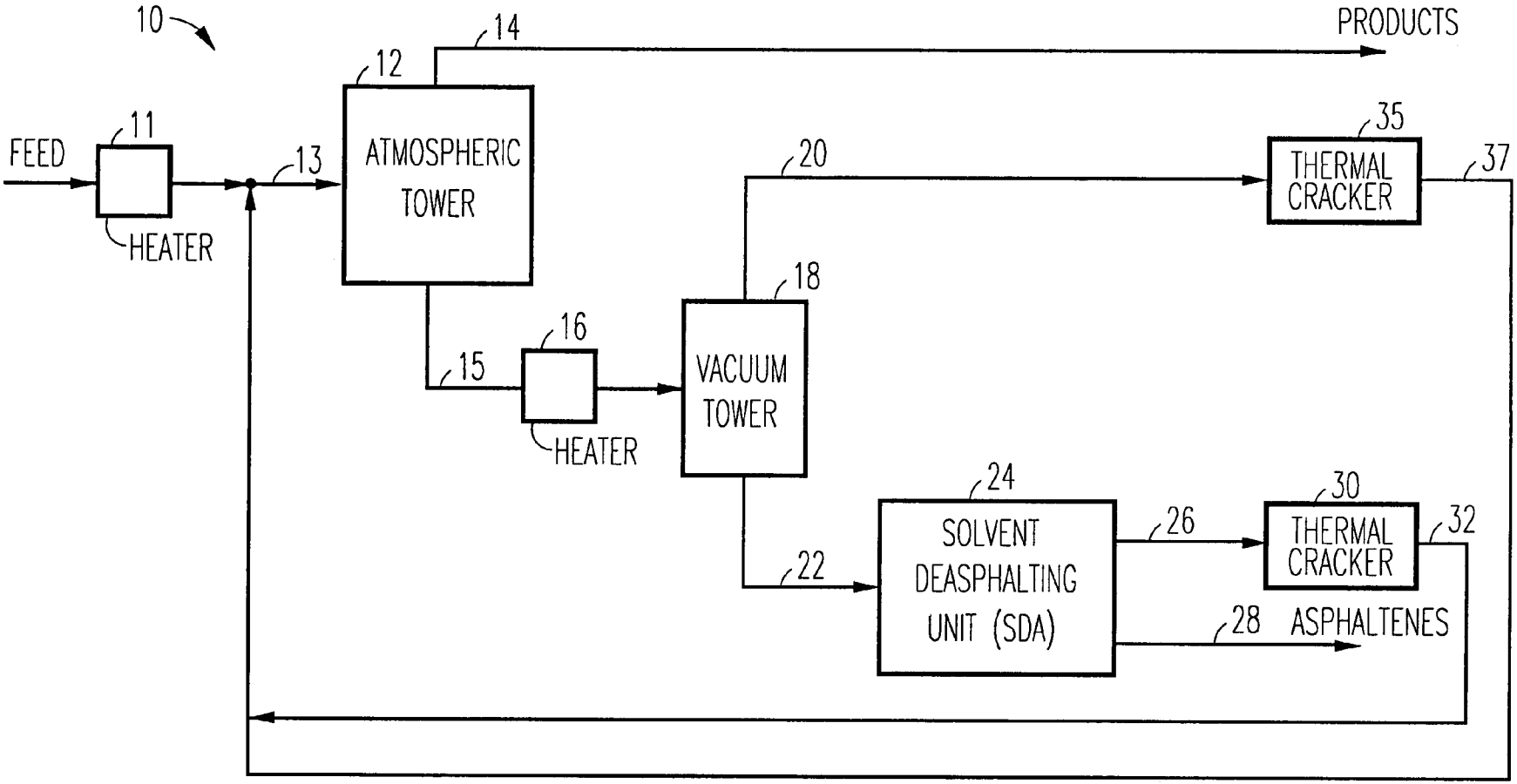
FIG. 1 is a block diagram of a first embodiment of the present invention for processing a hydrocarbon feed.
Figure 1A:
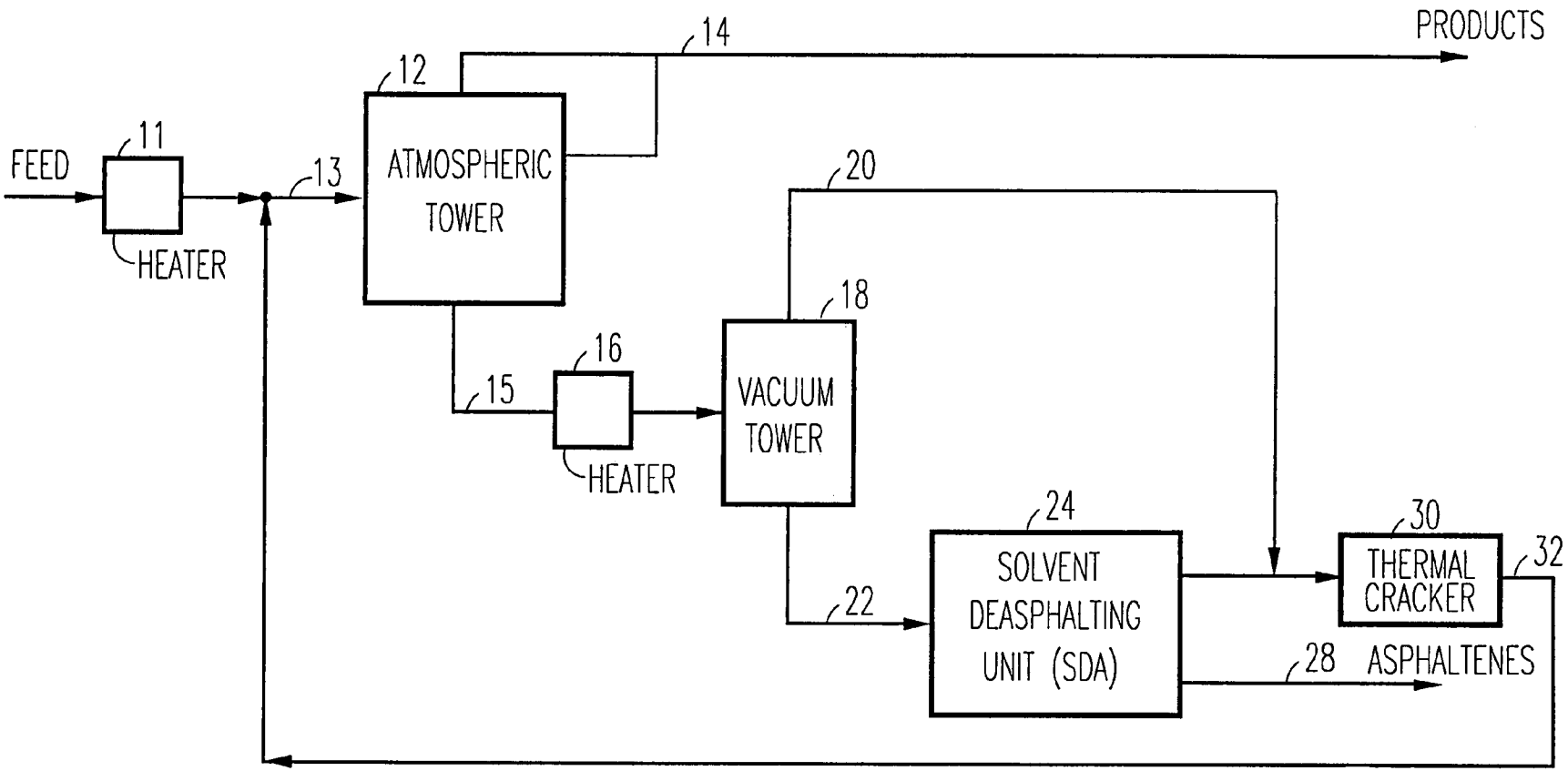
FIG. 1*a* is a block diagram of a modification of the first embodiment of the present invention mentioned above for processing a hydrocarbon feed.

Turning to the drawings, numeral 10 in FIG. 1 designates apparatus for processing heavy hydrocarbons in accordance with the present invention wherein heavy hydrocarbon feed is supplied to heater 11 and the heated heavy hydrocarbon feed is fed to atmospheric fractionating tower 12. Atmospheric fractionating tower 12 produces light atmospheric fractions in line 14 and atmospheric bottoms in line 15. The atmospheric bottoms in line 15 are then supplied to heater 16 and the heated atmospheric bottoms are supplied to vacuum fractionating tower 18 which produces light vacuum fractions in line 20 and vacuum residue in line 22. The vacuum residue in line 22 is then supplied to solvent deasphalting unit 24 which produces deasphalted oil in line 26 and asphaltenes in line 28. Deasphalted oil in line 26 is supplied to thermal cracker 30 that produces thermally cracked product in line 32 that is recycled to inlet 13 of atmospheric fractionating tower 12. Moreover, the light vacuum fractions in line 20 are supplied to further thermal cracker 35 for thermally cracking the lighter vacuum fractions and a further thermally cracked product is produced in line 37 that is recycled to inlet 13 of atmospheric fractionating tower 12. If preferred, rather than using further thermal cracker 35, the light vacuum fractions in line 20 can be thermally cracked in thermal cracker 30 together with the deasphalted oil supplied in line 26, see FIG. 1*a*.

Figure 2:
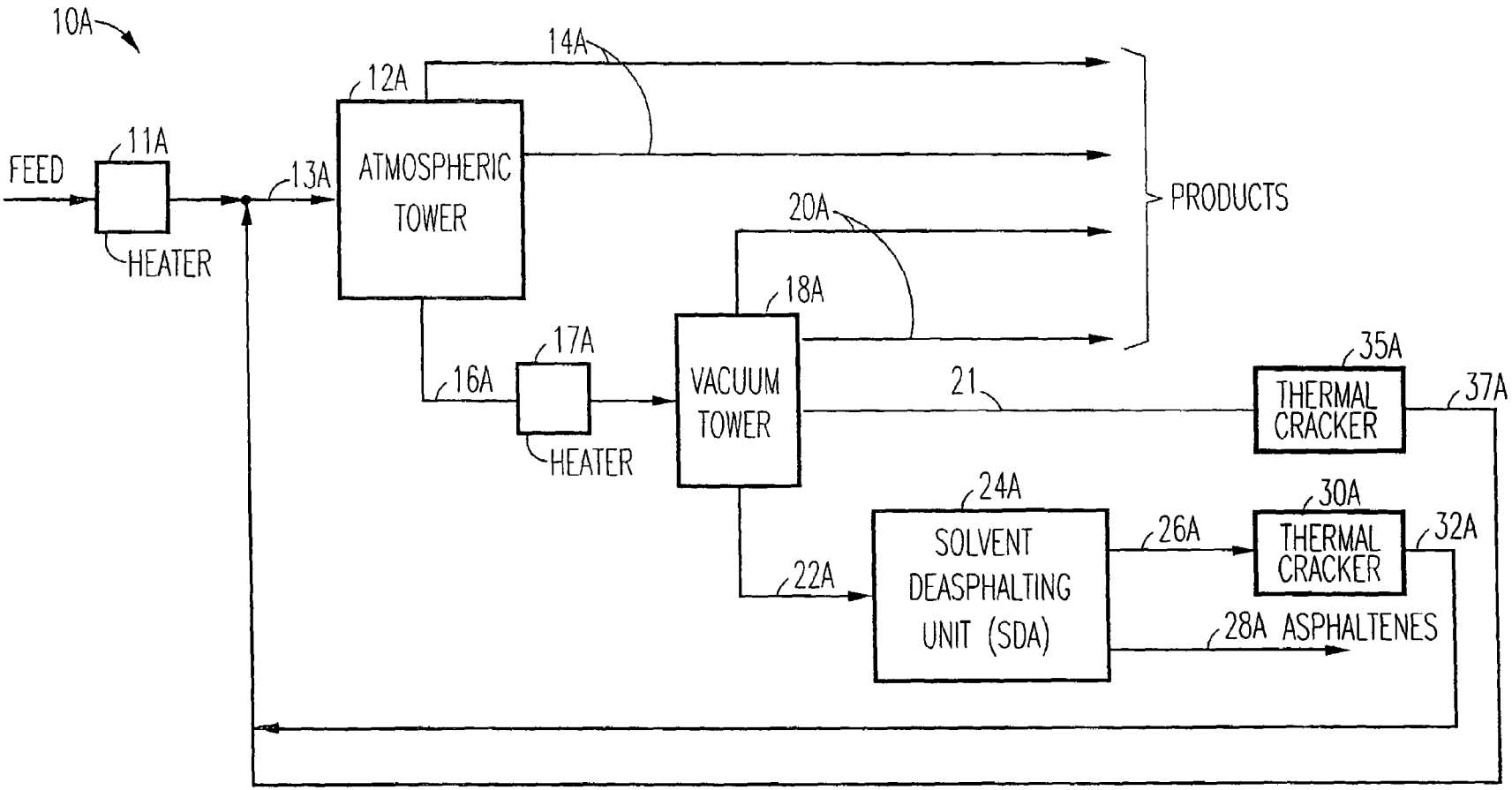
FIG. 2 is a block diagram of a second embodiment of the present invention for processing a hydrocarbon feed.

Numeral 10A in FIG. 2 designates another embodiment of apparatus for processing heavy hydrocarbons in accordance with the present invention wherein heavy hydrocarbon feed is supplied to heater 11A and the heated heavy hydrocarbon feed is fed to atmospheric fractionating tower 12A. Atmospheric fractionating tower 12A produces light atmospheric fractions in lines 14A and atmospheric bottoms in line 16A. The atmospheric bottoms in line 16A are then supplied to heater 17A and heated atmospheric bottoms are supplied vacuum frationating tower 18A which produces light vacuum fractions in lines 20A, heavier vacuum fractions in line 21 and vacuum residue in line 22A. The vacuum residue in line 22A are then supplied to solvent deasphalting unit 24A which produces deasphalted oil in line 26A and asphaltenes in line 28A. Deasphalted oil in line 26A is supplied to thermal cracker 30A that produces thermally cracked product in line 32A that is recycled to inlet 13A of atmospheric fractionating tower 12A. Moreover, the heavier vacuum fractions in line 21 are supplied to further thermal cracker 35A for thermally cracking the heavier vacuum fractions and a further thermally cracked product is produced in line 37A which is recycled to inlet 13A of atmospheric fractionating tower 12A.

Figure 3:
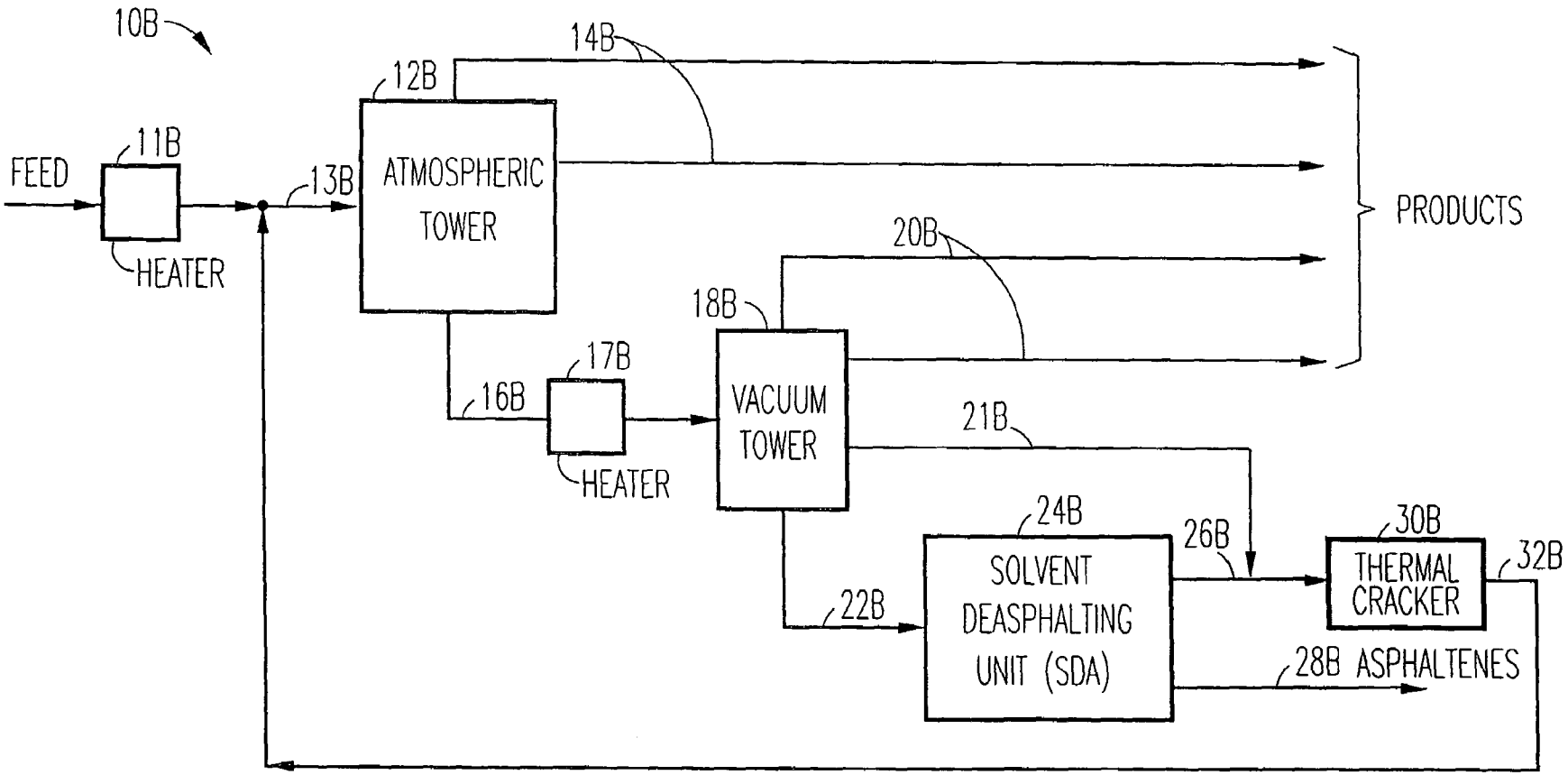
FIG. 3 is a block diagram of a third embodiment of the present invention for processing a hydrocarbon feed.

Turning now to the embodiment described with reference to FIG. 3, numeral 10B designates a further embodiment of apparatus for processing heavy hydrocarbons in accordance with the present invention. In this embodiment, heavy hydrocarbon feed is supplied to heater 11B and the heated heavy hydrocarbon feed is fed to atmospheric fractionating tower 12B. Atmospheric fractionating tower 12B produces light atmospheric fractions in lines 14B and atmospheric bottoms in line 16B. The atmospheric bottoms in line 16B are then supplied to heater 17B and the heated, atmospheric bottoms are supplied to vacuum fractionating tower 18B which produces light vacuum fractions in line 20B, heavier vacuum fractions in line 21B as well as vacuum residue in line 22B. The vacuum residue in line 22B is then supplied to solvent deasphalting unit 24B which produces deasphalted oil in line 26B and asphaltenes in line 28B. Deasphalted oil in line 26B is supplied to thermal cracker 30B that produces thermally cracked product in line 32B that is recycled to inlet 13B of atmospheric fractionating tower 12B. Moreover, the heavier vacuum fractions in line 21B are supplied to line 26B to form a combined product that is supplied to thermal cracker 30B.

Figure 4:
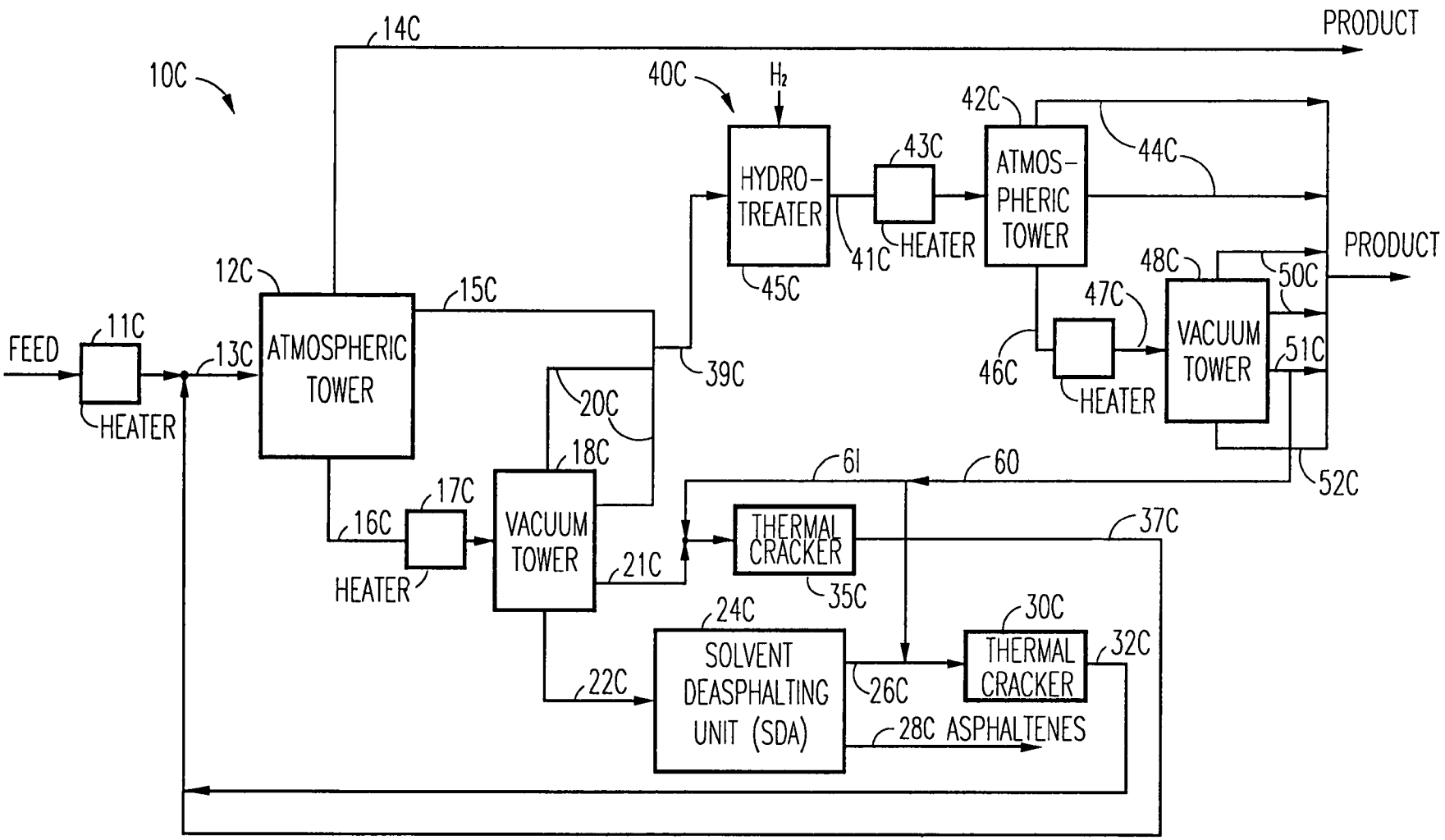
FIG. 4 is a block diagram of a further embodiment of the present invention for processing a hydrocarbon feed.

In another embodiment of the present invention, described with reference to FIG. 4, numeral 10C designates a still further embodiment of apparatus for processing heavy hydrocarbons in accordance with the present invention. In this embodiment, heavy hydrocarbon feed is supplied to heater 11C and the heated heavy hydrocarbon feed is fed to atmospheric fractionating tower 12C. Atmospheric fractionating tower 12C produces lighter atmospheric fractions in line 14C, light atmospheric fractions in line 15C and atmospheric bottoms in line 16C. The atmospheric bottoms in line 16C are then supplied to heater 17C and the heated atmospheric bottoms are supplied to vacuum fractionating tower 18C which produces light vacuum fraction in lines 20C, heavier vacuum fractions in line 21C and vacuum residue in line 22C. The vacuum residue in line 22C are then supplied to solvent deasphalting unit 24C which produces deasphalted oil in line 26C and asphaltenes in line 28C. Deasphalted oil in line 26C is supplied to thermal cracker 30C that produces thermally cracked product in line 32C that is recycled to inlet 13C of atmospheric fractionating tower 12C. Moreover, the heavier vacuum fractions in line 21C are supplied to further thermal cracker 35C for thermally cracking the heavier vacuum fractions and a further thermally cracked product is produced in line 37C which is recycled to inlet 13C of atmospheric fractionating tower 12C. Furthermore, this embodiment includes hydrogen donor apparatus 40C having hydrotreater 45C to which light fraction product in line 39C is supplied and which produces treated hydrocarbon feed in line 41C. Treated hydrocarbon feed in line 41C is supplied to heater 43C and the heated, treated hydrocarbon feed is then fed to further atmospheric fractionating tower 42C. Further atmospheric fractionating tower 42C produces further light atmospheric fractions in lines 44C and further atmospheric bottoms in line 46C. The further atmospheric bottoms in line 46C are then supplied to heater 47C and the heated, further atmospheric bottoms are supplied to further vacuum fractionating tower 48C that produces further light vacuum fractions in lines 50C, further heavier vacuum fractions in line 51C and further vacuum residue in line 52C. In this embodiment, portion of further heavier vacuum fractions or hydrogen donor stream present in line 51C is fed via line 60 to line 26C for input into thermal cracker 30C. A further portion of the hydrogen donor stream is fed to line 21C using line 61 for input into thermal cracker 35C.

Preferably, the ratio of the deasphalted oil present in line 26C to the amount of hydrogen donor stream present in line feed 60 is 0.25 to 4. Also, preferably, the ratio of the heavier vacuum fraction present in line 21C to the amount of hydrogen donor stream present in line 61 is also 0.25 to 4.

Figure 5:
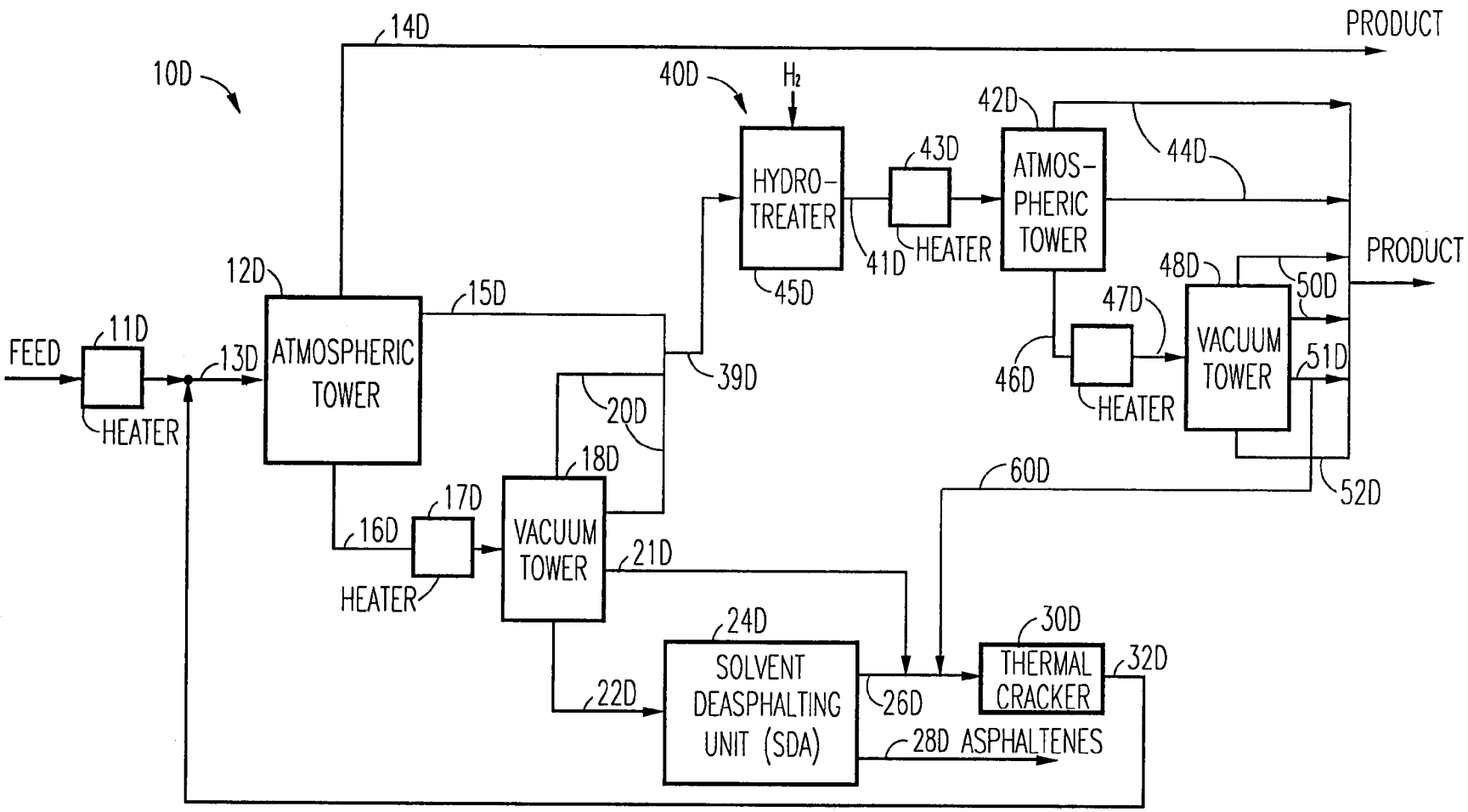
FIG. 5 is a block diagram of a still further embodiment of the present invention for processing a hydrocarbon feed.

In a further embodiment of the present invention, described with reference to FIG. 5, numeral 10D designates an even further embodiment of apparatus for processing heavy hydrocarbons in accordance with the present invention. In this embodiment, heavy hydrocarbon feed is supplied to heater 11D and the heated, heavy hydrocarbon feed is fed to atmospheric fractioning tower 12D. Atmospheric fractioning tower 12D produces lighter atmospheric fractions in line 14D, light fractions in line 15D and atmospheric bottoms in line 16D. The atmospheric bottoms in line 16D are then supplied to heater 17D and the heated atmospheric bottoms are supplied to vacuum fractioning tower 18D that produces light vacuum fractions in lines 20D, heavier vacuum fractions in line 21D and vacuum residue in line 22D. The vacuum residue in line 22D are then supplied to solvent deasphalting unit 24D that produces deasphalted oil in line 26D and asphaltenes in line 28D. Deasphalted oil in line 26D is supplied to thermal cracker 30D that produces thermally cracked product in line 32D that is recycled to inlet 13D of atmospheric fractioning tower 12D. Moreover, the heavier vacuum fractions in line 21D are also supplied to line 26D for input into thermal cracker 30D. Furthermore, this embodiment includes hydrogen donor apparatus 40D including hydrotreater 45D to which light fraction product in line 39D is supplied and that produces treated hydrocarbon in line 41D. Treated hydrocarbon feed in line 41D is supplied to heater 43D and heated, treated hydrocarbon feed is fed to further atmospheric fractioning tower 42D. Further atmospheric fractioning tower 42D produces further light atmospheric fractions in lines 44D and further atmospheric bottoms in lines 46D. The further atmospheric bottoms in line 46D are then supplied to heater 47D and the heated, further atmospheric bottoms are supplied to further vacuum fractionating tower 48D that produces further light vacuum fractions in lines 50D, further heavier vacuum fractions in line 51D and further vacuum residue in line 52D. In this embodiment, further heavier vacuum fractions or hydrogen donor stream present in line 51D are fed via line 60D to line 26D for input into thermal cracker 30D.

Preferably, the ratio of the hydrocarbon feed present in line 26D to the amount of hydrogen donor stream present in line feed 60D is 0.25 to 4.

As far as the embodiment of the present invention is concerned, described with reference to FIG. 6, numeral 10E designates another embodiment of apparatus for processing heavy hydrocarbons in accordance with the present invention. In this embodiment, heavy hydrocarbon feed is supplied to heater 11E and the heated, heavy hydrocarbon feed is fed to atmospheric fractionating tower 12E. Atmospheric fractionating tower 12E produces lighter atmospheric fractions in line 14E, light fractions in line 15E and atmospheric bottoms in line 16E. The lighter atmospheric fractions in line 14E and light fractions in line 15E are combined and the combined product is supplied to hydrotreater 19E that produces a hydrotreated product. The atmospheric bottoms in line 16E are then supplied to heater 17E and the heated, atmospheric bottoms are supplied to vacuum fractionating tower 18E which produces light vacuum fractions in lines 20E, heavier vacuum fractions in line 21E and vacuum residue in line 22E. The vacuum residue in line 22E is then supplied to deasphalting unit 24E which produces deasphalted oil in line 26E and asphaltenes in line 28E. Deasphalted oil in line 26E is supplied to thermal cracker 30E that produces thermally cracked product in line 32E that is recycled to inlet 13E of atmospheric fractionating tower 12E. Moreover, the light vacuum fractions in lines 20E, and heavier vacuum fractions in line 21E are supplied to line 39E. Portion of these fractions is supplied to further thermal cracker 35E for thermally cracking these vacuum fractions and a further thermally cracked product is produced in line 37E that is recycled to inlet 13E of atmospheric fractionating tower 12E. Furthermore, this embodiment includes a further hydrotreater 40E to which a further portion of fractions present in line 39E is supplied and that produces treated hydrocarbon feed in line 41E. In this embodiment, portion of treated hydrocarbon feed in line 41E is supplied via line 60E to line 26E for input into thermal cracker 30E. Preferably, the ratio of the deasphalted oil present in line 26E to the amount of treated hydrocarbon feed present in line 60E is 0.25 to 4. A further portion of the treated hydrocarbon feed in 41E is supplied to line 42E via line 62 for input into thermal cracker 35E.

Preferably, the ratio of the vacuum fractions present in line 42E to the amount of treated hydrocarbon feed present in line feed 62 is also 0.25 to 4.

Figure 6:
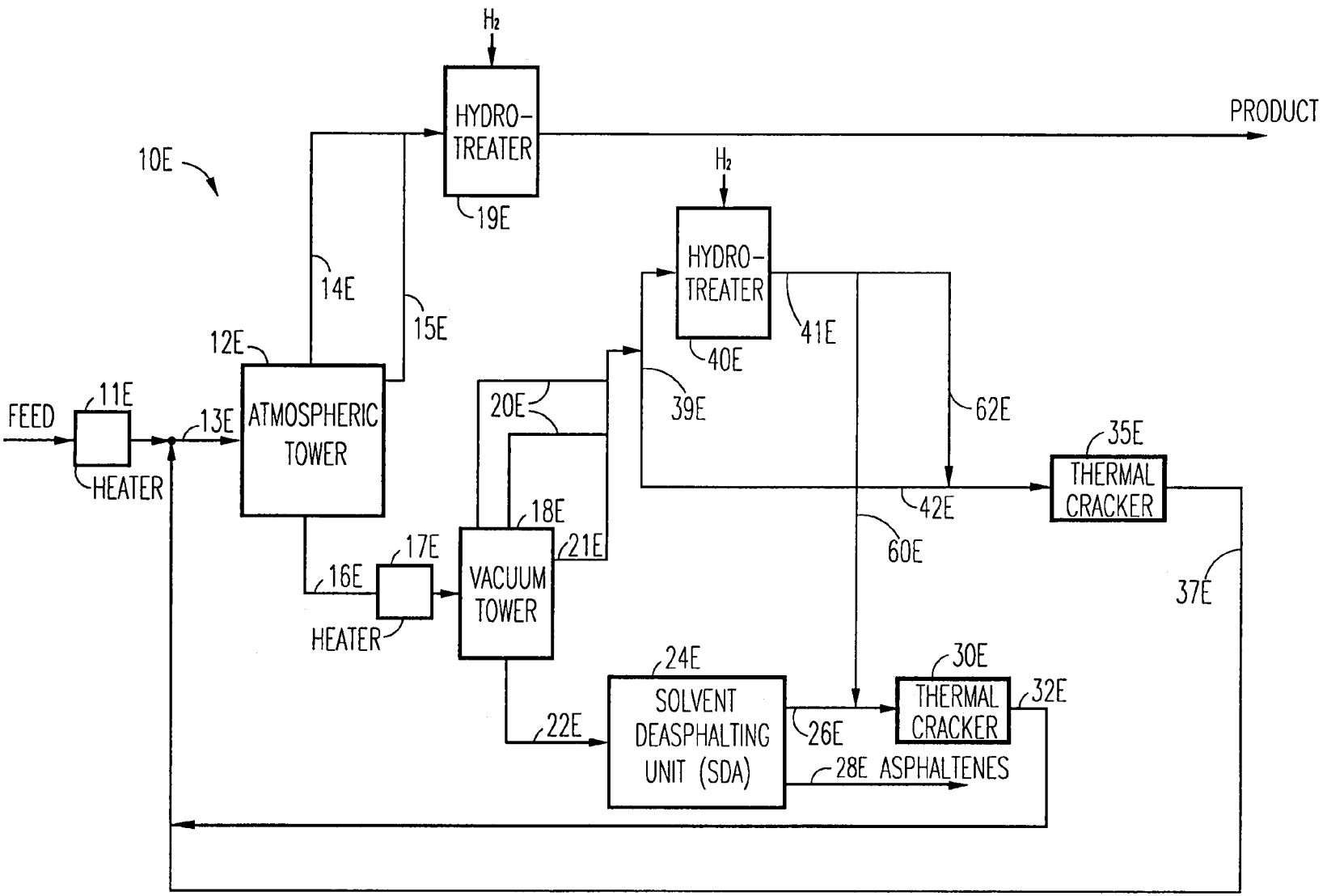
FIG. 6 is a block diagram of another embodiment of the present invention for processing a hydrocarbon feed.
Figure 7:
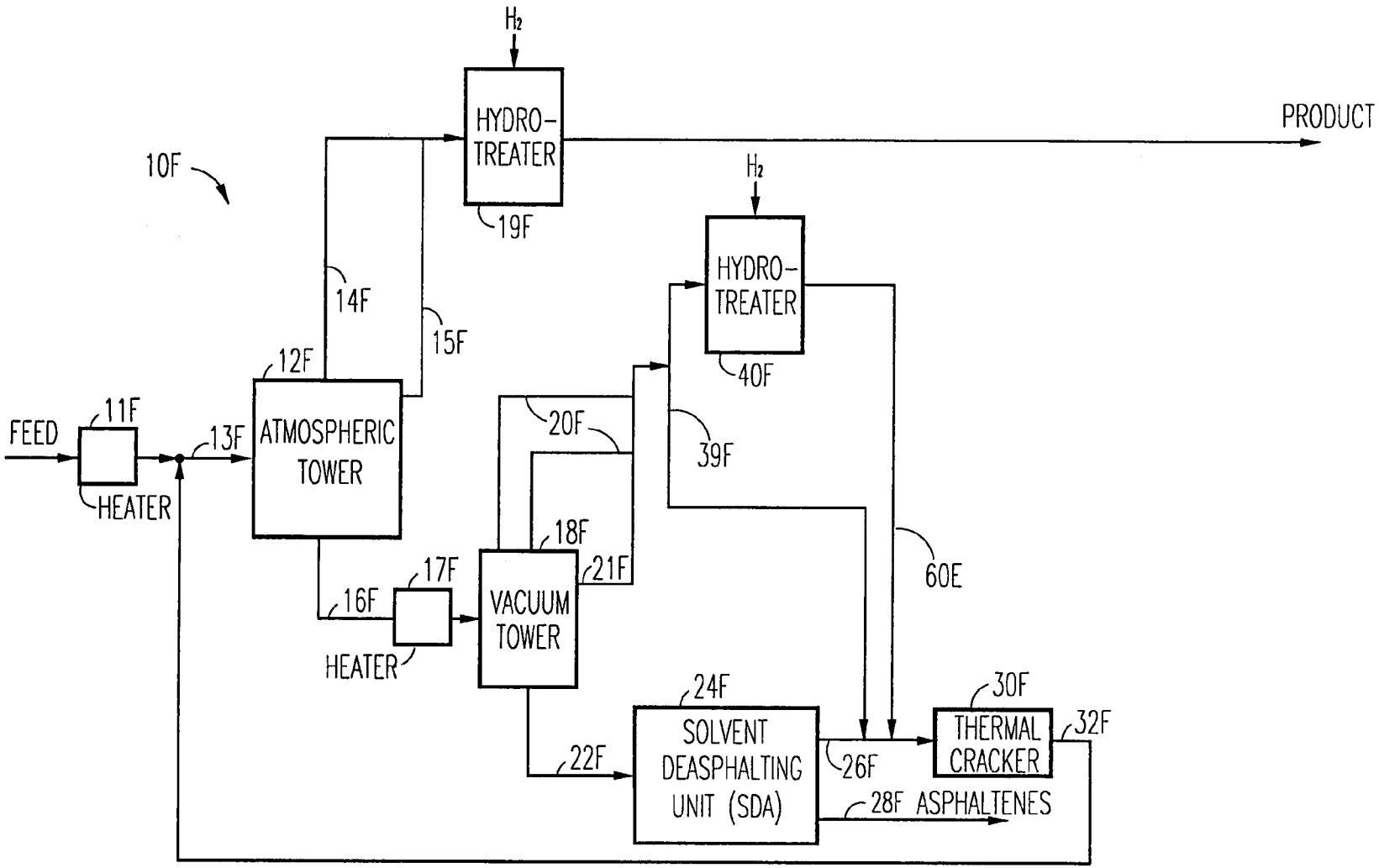
FIG. 7 is a block diagram of another embodiment of the present invention for processing a hydrocarbon feed.

Turning to the embodiment of the present invention described with reference to FIG. 7 similar apparatus to that described with reference to FIG. 6 is shown wherein numeral 10F designates a further embodiment of apparatus for processing heavy hydrocarbons in accordance with the present invention. In this embodiment, heavy hydrocarbon feed is supplied to heater 11F and the heated heavy hydrocarbon feed is fed to atmospheric fractionating tower 12F. Atmospheric fractionating tower 12F produces lighter atmospheric fractions in line 14F, light fractions in line 15F and atmospheric bottoms in line 16F. The lighter atmospheric fractions in line 14F and light fractions in line 15F are combined and the combined product is supplied to hydrotreater 19F that produces a hydrotreated product. The atmospheric bottoms in line 16F are then supplied to heater 17F and the heated atmospheric bottoms are supplied to vacuum fractionating tower 18F which produces light vacuum fractions in lines 20F, heavier vacuum fractions in line 21F and vacuum residue in line 22F. The vacuum residue in line 22F is then supplied to deasphalting unit 24F which produces deasphalted oil in line 26F and asphaltenes in line 28F. Deasphalted oil in line 26F is supplied to thermal cracker 30F that produces thermally cracked product in line 32F that is recycled to inlet 13F of atmospheric fractionating tower 12F. Moreover, the light vacuum fractions in lines 20F, and heavier vacuum fractions in line 21F are supplied to line 39F. Portion of these fractions is supplied to line 26F for input into thermal cracker 30F. Furthermore, this embodiment includes a further hydrotreater 40F to which a further portion of fractions present in line 39F is supplied and which produces treated hydrocarbon feed in line 60F. All of treated hydrocarbon feed in line 60F, in this embodiment, is supplied to line 26F for input into thermal cracker 30F. Preferably, the ratio of the hydrocarbon feed present in line 26F to the amount of treated hydrocarbon feed present in line feed 60F is 0.25 to 4.

Figure 8:
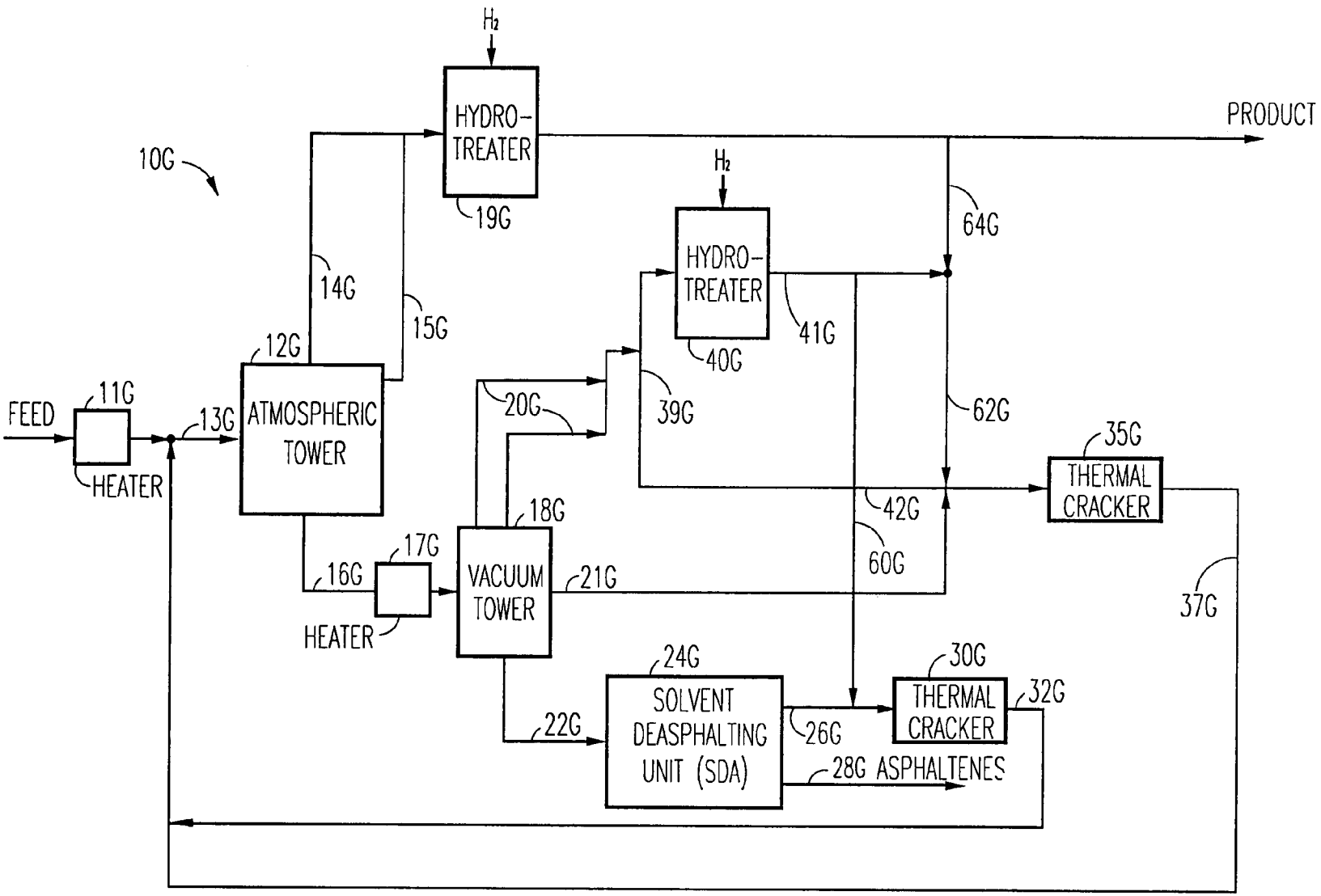
FIG. 8 is a block diagram of another embodiment of the present invention for processing a hydrocarbon feed.

Numeral 10G in FIG. 8 designated an additional embodiment of apparatus for processing heavy hydrocarbons in accordance with the present invention. In this embodiment, heavy hydrocarbon feed is supplied to heater 11G and the heated heavy hydrocarbon feed is fed to atmospheric fractionating tower 12G. Atmospheric fractionating tower 12G produces lighter atmospheric fractions in line 14G, light fractions in line 15G and atmospheric bottoms in line 16G. The lighter atmospheric fractions in line 14G and light fractions in line 15G are combined and the product is supplied to hydrotreater 19G that produces a hydrotreated product. The atmospheric bottoms in line 16G are then supplied to heater 17G and the heated atmospheric bottoms are supplied to vacuum fractionating tower 18G that produces light vacuum fractions in lines 20G, heavier vacuum fractions in line 21G and vacuum residue in line 22G. The vacuum residue in line 22G is then supplied to solvent deasphalting unit 24G which produces deasphalted oil in line 26G and asphaltenes in line 28G. Deasphalted oil in line 26G is supplied to thermal cracker 30G that produces thermally cracked product in line 32G that is recycled to inlet 13G of atmospheric fractionating tower 12G. Moreover, the light vacuum fractions in lines 20G are supplied to line 39G. Portion of these fractions is supplied to further thermal cracker 35G for thermally cracking these vacuum fractions and a further thermally cracked product is produced in line 37G which is recycled to inlet 13G of atmospheric fractionating tower 12G. In addition, heavier vacuum fractions in line 21G are supplied to this portion of fractions supplied to further thermal cracker 35G. Furthermore, this embodiment includes a further hydrotreater 40G to which a further portion of fractions present in line 39G is supplied and which produces treated hydrocarbon feed in line 41G. In this embodiment, portion of treated hydrocarbon feed in line 41G is supplied via line 60G to line 26G for input into thermal cracker 30G. A further portion of the treated hydrocarbon feed in line 41G is supplied via line 62G to line 42G for input into further thermal cracker 35G. Preferably, the ratio of the vacuum fractions present in line 42G to the amount of treated hydrocarbon feed present in line feed 62G is 0.25 to 4. Also in this embodiment, portion for the hydrotreated product exiting hydrotreater 19G is supplied via line 64G to treated hydrocarbon feed in line 41G exiting further hydrotreater 40G. Consequently, portion of the hydrotreated product supplied to line 41G is supplied to line 26G for input into thermal cracker 30G while another portion of the hydrotreated product supplied to line 41G is supplied to further thermal cracker 35G.

Preferably, the ratio of the deasphalted oil present in line 26G to the amount of treated hydrocarbon feed present in line feed 60G is 0.25 to 4.

Figure 9:
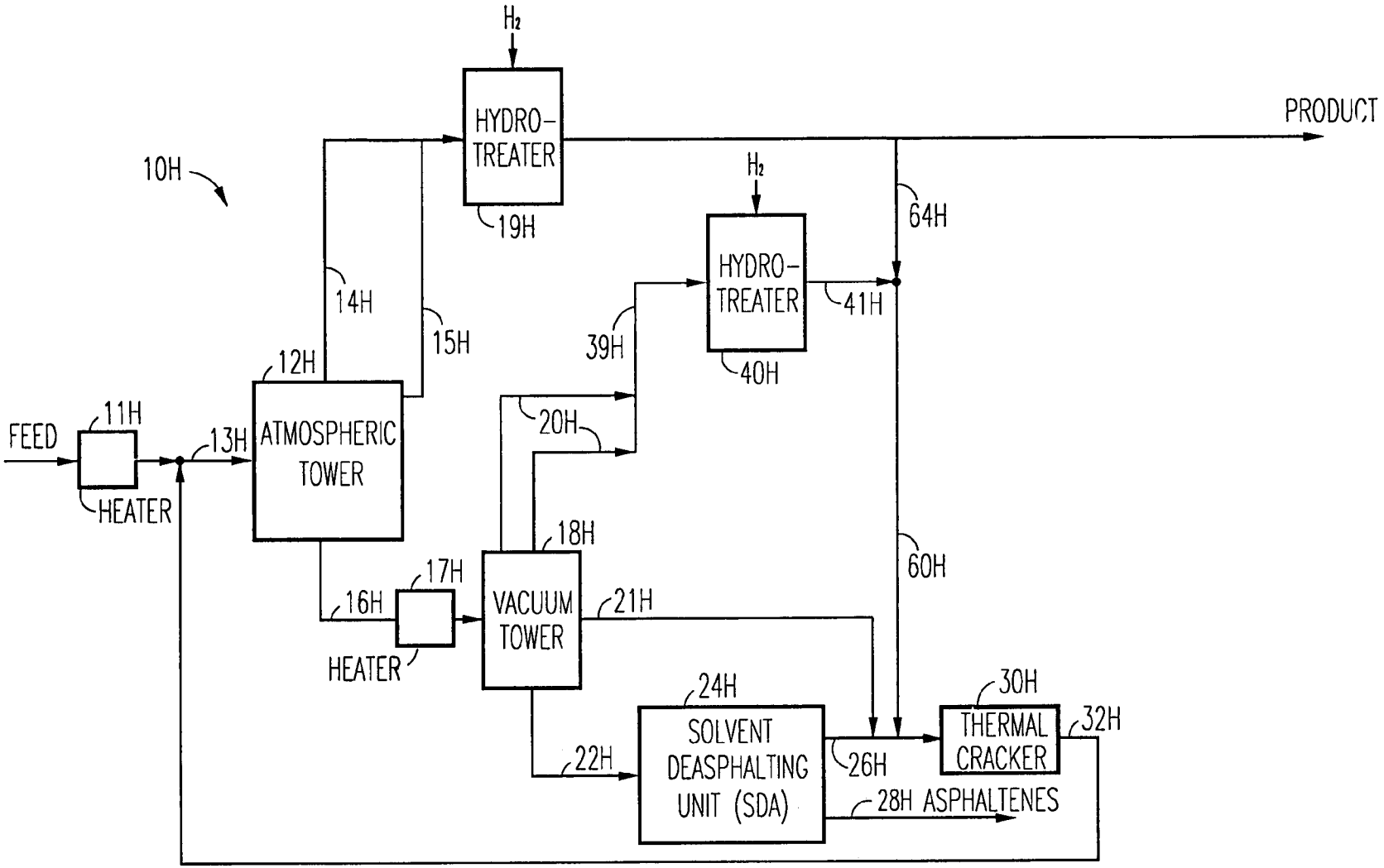
FIG. 9 is a block diagram of another embodiment of the present invention for processing a hydrocarbon feed.

As far as the embodiment of the present invention described with reference to FIG. 9 is concerned, similar apparatus to that described with reference to FIG. 8 is shown wherein numeral 10H designates a further embodiment of apparatus for processing heavy hydrocarbons in accordance with the present invention. In this embodiment, heavy hydrocarbon feed is supplied to heater 11H and the heated heavy hydrocarbon feed is fed to atmospheric fractionating tower 12H. Atmospheric fractionating tower 12H produces lighter atmospheric fractions in line 14H, light fractions in line 15H and atmospheric bottoms in line 16H. The lighter atmospheric fractions in line 14H and light fractions in line 15H are combined and the combined product is supplied to hydrotreater 19H that produces a hydrotreated product. The atmospheric bottoms in line 16H are then supplied to heater 17H and the heated atmospheric bottoms are supplied to vacuum fractionating tower 18H which produces light vacuum fractions in lines 20H, heavier vacuum fractions in line 21H and vacuum residue in line 22H. The vacuum residue in line 22H is then supplied to solvent deasphalting unit 24H which produces deasphalted oil in line 26H and asphaltenes in line 28H. Deasphalted oil in line 26H is supplied to thermal cracker 30H that produces thermally cracked product in line 32H that is recycled to inlet 13H of atmospheric fractionating tower 12H. Moreover, the light vacuum fractions in lines 20H are supplied to line 39H for input into further hydrotreater 40H which produces treated hydrocarbon feed in line 41H that is supplied via line 60H to line 26H for input into thermal cracker 30H. Heavier vacuum fractions in line 21H are also supplied to line 26H for input into thermal cracker 30H. In this embodiment, portion for the hydrotreated product exiting hydrotreater 19H is supplied via line 64H to treated hydrocarbon feed in line 41H exiting further hydrotreater 40H. Consequently, the portion of the hydrotreated product supplied to line 41H is supplied to line 26H for input into thermal cracker 30H.

Preferably, the ratio of the hydrocarbon feed present in line 26H to the amount of treated hydrocarbon feed present in line feed 60H is 0.24 to 4.

The present invention permits the efficient control of the final boiling point of the product stream. This has importance since the value of the upgraded product produced in accordance with the present invention changes for each specific refinery configuration. Refineries are sensitive to the final boiling point of this upgraded product and material that has high value for one may be valued at the value of vacuum residue by another. Thus, the value of the product or synthetic crude produced in accordance with the present invention and supplied to the refinery can be different for a different balance of the different fractions produced. Refineries are differentiated one from another by the products and fractions they are willing to accept. Consequently, sometimes, the value of a product in the boiling range between 650-1050° F. is low even if its quality is high. Here, refineries may prefer different divisions of boiling point ranges of the improved products in accordance with the processing units or apparatus downstream. As a result if e.g. a refinery is the client of the product or the user of the process, there is an advantage of flexibility of the final boiling point in general and in the actual balance between the vacuum gas oil and the atmospheric product fractions. Furthermore, often a diluent needs to be added to the crude oil in order to meet the pipeline specifications for conveying the heavy oils. Thus, the present invention permits conversion of part of the crude oil into diluent that can be used in the transportation of more viscous oil.

Moreover, as far as combustion turbines are concerned, it is important to control the viscosity and density of the product thus permitting substantially avoiding potential risks from occurring in the fuel system and injectors of the turbine.

In addition, it should be noted that supply means or lines mentioned in this specification refer to suitable conduits, etc.

Furthermore, it should be pointed out that the present invention includes as well the method for operating the apparatus disclosed with reference to the above-described figures.

It is believed that the advantages and improved results furnished by the method and apparatus of the present invention are apparent from the foregoing description of the invention. Various changes and modifications may be made without departing from the spirit and scope of the invention as described in the claims that follow.

What is claimed is:

1. A method for processing a heavy hydrocarbon feed including the steps comprising, in sequential order:

a) supplying said heavy hydrocarbon feed to a heater for heated said heavy hydrocarbon feed;

b) supplying said heated heavy hydrocarbon feed to an atmospheric fractionating tower for fractionating the heated heavy hydrocarbon feed fed to the inlet of the atmospheric fractionating tower producing light atmospheric fractions and atmospheric bottoms;

c) supplying said atmospheric bottoms to a further heater for heating said atmospheric bottoms and producing heated atmospheric bottoms;

d) supplying said heated atmospheric bottoms to a vacuum fractionating tower for fractionating said heated atmospheric bottoms and producing light vacuum fractions and vacuum residue;

e) supplying said vacuum residue to a solvent deasphalting (SDA) unit for producing deasphalted oil (DAO) and asphaltenes from said vacuum residue;

f) supplying said deasphalted oil to a deasphalted oil thermal cracker for thermally cracking said deasphalted oil and producing a thermally cracked product which is recycled only to the inlet of said atmospheric fractionating tower; and g) supplying only a heavy portion of said light vacuum fractions to a light vacuum fraction thermal cracker for thermally cracking said light vacuum fractions for producing a further cracked product which is recycled only to the inlet of said atmospheric fractionating tower;

h) supplying said light atmospheric fractions produced by said atmospheric fractionating tower to a hydrogen donor producing system for processing a portion of said light atmospheric fractions produced by said atmospheric fractionating tower and producing a hydrogen donor stream, such that the following steps are carried out in sequence;

i) supplying a portion of said light atmospheric fractions produced by said atmospheric fractionating tower to a hydrotreater for producing a treated hydrocarbon feed;

j) supplying said treated hydrocarbon feed to a still further heater for producing a heated, treated hydrocarbon stream;

k) supplying said heated, treated hydrocarbon stream to a further atmospheric fractionating tower for fractionating said heated, treated hydrocarbon stream for producing further light atmospheric fractions and further atmospheric bottoms;

l) supplying said further atmospheric bottoms to an additional heater for heating said further atmospheric bottoms and producing heated further atmospheric bottoms; and m) supplying said heated further atmospheric bottoms to a further vacuum fractionating tower for fractionating said heated further atmospheric bottoms and producing further lighter vacuum fractions and further vacuum residue wherein a portion of the heavier portion of said further lighter vacuum fractions or hydrogen donor stream is supplied to said deasphalted oil thermal cracker and a further portion of the heavier portion of said further lighter vacuum fractions or hydrogen donor stream is supplied to said light vacuum fraction thermal cracker.

* * * * *